US012281868B2

(12) United States Patent
Zeider et al.

(10) Patent No.: US 12,281,868 B2
(45) **Date of Patent: *Apr. 22, 2025**

(54) INCREASED CAPACITY AMMUNITION MAGAZINE

(71) Applicant: Shield Arms, LLC, Bigfork, MT (US)

(72) Inventors: Brandon Michael Zeider, Bigfork, MT (US); Seth Martin Berglee, Joliet, MT (US); Raymond Dean Brandly, Oklahoma City, OK (US); Cody Blighe Greenfield, Norman, OK (US)

(73) Assignee: Shield Arms, LLC, Bigfork, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/349,642

(22) Filed: Jul. 10, 2023

(65) Prior Publication Data

US 2023/0349654 A1 Nov. 2, 2023

Related U.S. Application Data

(63) Continuation-in-part of application No. 17/084,057, filed on Oct. 29, 2020, now Pat. No. 11,747,102.
(Continued)

(51) Int. Cl.
*F41A 9/71* (2006.01)
*F41A 9/69* (2006.01)
(Continued)

(52) U.S. Cl.
CPC *F41A 9/71* (2013.01); *F41A 9/69* (2013.01); *F41A 9/70* (2013.01); *F41A 35/06* (2013.01)

(58) Field of Classification Search
CPC ..... F41A 9/61; F41A 9/64; F41A 9/65; F41A 9/69; F41A 9/71
(Continued)

(56) References Cited

U.S. PATENT DOCUMENTS 295,563 A 3/1884 Lee et al.
303,992 A 8/1884 Diss
(Continued)

FOREIGN PATENT DOCUMENTS

DE 3208504 A1 9/1983
DE 3422334 A1 12/1985
(Continued)

*Primary Examiner* — Jonathan C Weber
(74) *Attorney, Agent, or Firm* — Wood Herron & Evans LLP

(57) ABSTRACT

An increased capacity replacement firearm ammunition magazine for a polymer or polymer-over-metal single stack firearm ammunition magazine for a Glock® handgun, comprises a metallic body dimensioned to compatibly replace the single stack magazine for the Glock® handgun, the single stack magazine having a body having exterior dimensions defined by polymer or polymer-over-metal forward, aft, and side walls, the metallic body having exterior dimensions defined by metallic forward, aft, and side walls, an exterior width dimension of the metallic side walls compatibly matching an exterior width dimension of the side walls of the single stack magazine body, the metallic walls being thinner than the walls of the single stack magazine, the thinner metallic walls allowing an at least partially laterally offset arrangement of cartridges in the metallic body, the forward wall of the metallic body including at least one spacer extending along the forward wall, the spacer sized such that a forward-to-aft exterior dimension of the metallic body compatibly matches a forward-to-aft exterior dimension of the single stack magazine body, a length dimension of the metallic body compatibly matches a length dimension of the single stack magazine body, a cut-out in the metallic body adapted to receive a firearm magazine catch therein, the cut-out including an upper edge, and polymer over at least the upper edge of the cut-out.

41 Claims, 11 Drawing Sheets

Related U.S. Application Data

(60) Provisional application No. 63/368,118, filed on Jul. 11, 2022, provisional application No. 62/927,158, filed on Oct. 29, 2019.

(51) Int. Cl.
*F41A 9/70* (2006.01)
*F41A 35/06* (2006.01)

(58) Field of Classification Search
USPC ..... 42/50, 49.01, 6, 7; 89/33.1
See application file for complete search history.

(56) References Cited

U.S. PATENT DOCUMENTS 999,387 A 8/1911 Mauser
1,348,172 A 8/1920 Hammond
1,350,619 A 8/1920 Oscar, V
1,407,633 A 2/1922 Burton
2,715,290 A 8/1955 Harvey
2,715,789 A 8/1955 Garand
2,777,235 A 1/1957 Hopkins
2,903,809 A 9/1959 Stoner
3,087,270 A 4/1963 Stoner
3,440,751 A 4/1969 Fremont
3,619,929 A 11/1971 Fremont
3,736,686 A 6/1973 Moller et al.
4,127,954 A 12/1978 Hausmann
4,589,218 A 5/1986 Teppa
4,638,581 A 1/1987 Moore
4,825,744 A 5/1989 Glock
5,099,595 A 3/1992 Chesnut et al.
5,113,605 A 5/1992 Kim
5,357,703 A * 10/1994 Chesnut ..... F41A 17/38 42/50
5,495,687 A 3/1996 Waiser
5,555,661 A 9/1996 Yap
5,566,488 A 10/1996 Yap
5,704,148 A * 1/1998 Valorose ..... F41A 9/65 42/49.02
5,755,052 A 5/1998 Keeney
5,956,878 A 9/1999 Yang
7,121,035 B2 10/2006 Greer
7,937,872 B1 5/2011 Fluhr
8,061,071 B2 11/2011 Fitzpatrick et al.
8,225,541 B2 * 7/2012 Bigley ..... F41A 9/70 42/49.01
8,572,877 B2 11/2013 Sullivan
8,689,475 B2 4/2014 Battaglia
8,752,318 B2 6/2014 Pulit, Jr.
8,776,419 B2 7/2014 Obermeit
9,347,721 B2 5/2016 Larson, Jr.
9,945,628 B2 4/2018 Kielsmeier et al.
10,619,959 B1 4/2020 Loveday, IV et al.
10,809,027 B2 10/2020 Michut
10,809,028 B2 10/2020 Underwood et al.
10,816,289 B2 10/2020 Davidson
11,092,397 B2 8/2021 Müller
11,143,474 B2 10/2021 Maldonado
11,747,102 B2 9/2023 Zeider et al.
11,927,418 B2 3/2024 Zeider et al.
11,927,419 B2 3/2024 Zeider et al.
2011/0005115 A1 1/2011 Cahill
2012/0124879 A1 5/2012 Larue
2015/0192377 A1 7/2015 Larson, Jr.
2016/0025436 A1 * 1/2016 Higley ..... F41A 9/65 42/49.01
2017/0051990 A1 2/2017 Purkiss
2018/0202734 A1 7/2018 Dowling et al.
2018/0347928 A1 12/2018 Fitzpatrick et al.
2019/0339035 A1 11/2019 Coombs et al.
2021/0080204 A1 3/2021 Yeates et al.
2021/0325133 A1 10/2021 Kharalampiev

FOREIGN PATENT DOCUMENTS

EP 0154357 B1 8/1988
WO WO-2019144160 A1 * 7/2019 ..... B29C 45/14336

* cited by examiner

INCREASED CAPACITY AMMUNITION MAGAZINE

RELATED APPLICATIONS

This application claims the priority benefit of U.S. Provisional Patent Application No. 63/368,118 filed Jul. 11, 2022, and is a continuation-in-part of U.S. Nonprovisional patent application Ser. No. 17/084,057 filed Oct. 29, 2020, which claims the priority benefit of U.S. Provisional Patent Application No. 62/927,158 filed Oct. 29, 2019, all of which are hereby incorporated by reference herein as if fully set forth in their entirety.

FIELD OF THE INVENTION

The present invention relates to removable ammunition magazines for handguns. More particularly, it relates to a magazine that provides increased capacity over a single stack magazine of similar tube length without increasing its external width and compensating for fore/aft size reduction.

BACKGROUND OF THE INVENTION

Semiautomatic handguns typically use removable ammunition magazines that are insertable into a magazine well formed in the grip of the handgun. These are typically known as "box" magazines and have a tubular body that is substantially rectangular in cross section. A row of ammunition cartridges is aligned within the body and is pushed upwardly by a follower that is biased by a compression spring. The bottom end of the body is closed by a removeable floor plate that retains the spring and provides an end against which the spring bears. At the top end of the body, known as the mouth, an ammunition cartridge is presented and held in position by feed lips. As the slide or bolt face cycles forward, this presented cartridge is stripped from the feed lips and guided into the chamber of the barrel.

The size and shape of these removable handgun magazines vary depending on the model of the handgun, caliber of the ammunition, and number of ammunition cartridges to be held. Some handguns require a specialized magazine that is specific to the handgun's make or model. In other examples, such as the M19111A1, standards have been adopted for a non-proprietary handgun pattern such that ammunition magazines will generally fit and operate in any handgun of that pattern, regardless of the manufacturer.

Some handgun magazines hold rimless cartridges substantially parallel to one another in a single row. These are known as "single stack" magazines. Other magazine designs hold cartridges substantially parallel to each other in an alternating double column. These are known as "double stack" magazines. A double stack magazine will hold more rounds than a single stack magazine of the same length, but is significantly wider. A wider, double stack magazine requires the handgun to have a wider grip, which may be more difficult for a smaller hand to hold and may make the grip of the handgun less concealable under clothing.

The follower in a single stack magazine will typically have a flat top surface that bears against an ammunition cartridge and will be retained by the feed lips when the cartridges have been depleted. A double stack magazine follower is laterally asymmetrical to induce the staggered position of rounds as they are loaded into the magazine. A single round will be centered by the feed lips, even though the force applied by the follower may be off-center because of its laterally asymmetric shape.

The body of most detachable box magazines is made from either metal (such as steel or aluminum), a molded polymer plastic material, or a combination of these materials. Original equipment manufacturer (OEM) magazines made by Glock® for its handguns have a body made from a combination of materials and may be described as either polymer with a full or partial metal liner, or as a metal body with a polymer jacket. This combination of materials has advantageous qualities, but it results in a relatively thick magazine wall. Some aftermarket magazines for Glock® handguns are all or mostly polymer. Magazines for most Glock® handgun models are of the double stack variety. However, Glock® has designed and sold at least one model (e.g., Glock® models 43, 43X, and/or 48) in which the magazine holds cartridges in only a single row (single stack) or in only slightly staggered rows in order to keep the overall thickness of the handgun to a minimum. However, because it does not accept a double stack magazine, the ammunition capacity of these models' single stack magazines is less than that of a double stack magazine of similar length. In the case of the Glock® 43, its OEM "flush fit" magazine has a capacity of 6 rounds, whereas in the case of the Glock® 43X and 48, their OEM "flush fit" magazines have a capacity of 10 rounds.

If a steel magazine is made to fit in the cross-sectional space designed for a polymer magazine (or in the case of Glock® OEM magazines, polymer over steel), the increase in interior side-to-side width can allow increased capacity by going from a single stack to a double stack. However, it leaves too much interior room in the front to back (fore/aft) direction. This increased interior front-to-back space is a problem because the rounds can ride too far forward and make contact with the slide stop. Others have filled such extra space with a shim, attached to either the interior or exterior of the forward wall of the magazine tube. However, this approach requires an additional manual step in the manufacturing process, adding cost and weight.

If a steel magazine is used in a Glock® handgun, the Glock® OEM polymer magazine catch can wear down over time creating reliability issues. This is because the steel of the magazine is much harder than the polymer of the magazine catch. One prior solution to this problem is to substitute an after-market metallic (aluminum, steel, or MIM) magazine catch for the Glock® OEM polymer magazine catch. The drawback to this solution is the necessity of purchasing and installing a metallic after-market magazine catch. It is desirable to use steel magazines in Glock® handguns, without the necessity of purchasing and installing an after-market metallic magazine catch, and without the steel magazine wearing the Glock® OEM polymer magazine catch.

SUMMARY OF THE INVENTION

In one aspect, an increased capacity replacement firearm ammunition magazine for a polymer or polymer-over-metal single stack firearm ammunition magazine for a Glock® handgun, comprises a metallic body dimensioned to compatibly replace the single stack magazine for the Glock® handgun, the single stack magazine having a body having exterior dimensions defined by polymer or polymer-over-metal forward, aft, and side walls, the metallic body having exterior dimensions defined by metallic forward, aft, and side walls, an exterior width dimension of the metallic side walls compatibly matching an exterior width dimension of the side walls of the single stack magazine body, the metallic walls being thinner than the walls of the single stack magazine, the thinner metallic walls allowing an at least partially laterally offset arrangement of cartridges in the metallic body, the forward wall of the metallic body including at least one spacer extending along the forward wall, the spacer sized such that a forward-to-aft exterior dimension of the metallic body compatibly matches a forward-to-aft exterior dimension of the single stack magazine body, a length dimension of the metallic body compatibly matches a length dimension of the single stack magazine body, a cut-out in the metallic body adapted to receive a firearm magazine catch therein, the cut-out including an upper edge, and polymer over at least the upper edge of the cut-out.

The Glock® handgun can be a Glock® 43X handgun, the single stack magazine can have an ammunition capacity of ten 9×19 mm cartridges, and the replacement magazine can have an ammunition capacity of fifteen 9×19 mm cartridges.

The spacer can be integrally formed as a part of the forward wall of the metallic body, or the spacer can be integrally formed as a part of the polymer.

The polymer can be overmolded over the upper edge of the cut-out. The metallic body can include at least one through hole above the upper edge of the cut-out, whereby when the polymer is overmolded the polymer flows through the through hole to secure the polymer to inner and outer surfaces of the metallic body and to the upper edge of the cut-out. The metallic body can include left and right cut-outs and polymer overmolded over at least the upper edge of each cut-out, whereby the magazine can function with a firearm having a magazine catch reversible for left-handed or right-handed actuation. The metallic body can include at least one through hole above the upper edge of each cut-out, whereby when the polymer is overmolded the polymer flows through the through holes to secure the polymer to inner and outer surfaces of the metallic body and to the upper edges of the cut-outs. The polymer can extend from the left cut-out, around the forward wall of the metallic body, and to the right cut-out. The spacer can include a recess therein to accommodate the polymer extending around the forward wall of the metallic body.

The polymer can be formed as a resilient clip which snaps into the cut-out and over the upper edge of the cut-out. The metallic body can include left and right cut-outs, and the polymer clip can extend from the left cut-out, around a forward wall of the metallic body, and to the right cut-out, and snap into each cut-out and over the upper edge of each cut-out, whereby the magazine can function with a firearm having a magazine catch reversible for left-handed or right-handed actuation. The spacer can include a recess therein to accommodate the polymer clip extending around the forward wall of the metallic body.

The clip can comprise a front portion and left and right side portions, the front portion including a generally vertical living hinge, each left and right side portion including three resilient and vertically spaced fingers which fit into respective ones of the left and right cut-outs, middle ones of the fingers each including a lip that resiliently snaps around a forward vertical edge of its respective cut out, at least the right portion including an L-shaped structure projecting upwardly from an upper one of the fingers, the L-shaped structure including a generally vertical leg portion and a generally horizontal foot portion and a generally triangular gusset interconnecting the leg and foot portions, and the right cut-out including an upwardly extending notch to accommodate the gusset, whereby when installed the foot portion covers the upper edge of the cut-out and the leg portion overlies an inner surface of the body above the upper edge of the cut-out.

In another aspect, an increased capacity replacement firearm ammunition magazine for a polymer-over-metal single stack firearm ammunition magazine for a Glock® handgun, comprises a metallic tubular body having a forward wall, a rearward wall, a first side wall, and a second opposite side wall, the metallic tubular body walls having a wall thickness and the metallic tubular body having a length, the single stack magazine for the Glock® handgun having a polymer-over-metal tubular body having a forward wall, a rearward wall, a first side wall, and a second opposite side wall, the single stack magazine tubular body walls having a wall thickness and the single stack magazine tubular body having a length, the wall thickness of the metallic tubular body walls being less than the wall thickness of the tubular body walls of the single stack magazine, the length of the metallic tubular body being substantially the same as the length of the single stack magazine tubular body, the forward wall of the metallic tubular body having at least one spacer projecting forwardly therefrom, the metallic tubular body having an internal fore-to-aft dimension spanning between interior surfaces of the forward and rearward walls, an external fore-to-aft dimension spanning between a forward edge of the at least one spacer and an exterior surface of the rearward wall, an internal side-to-side dimension spanning between interior surfaces of the side walls, and an external side-to-side dimension spanning between exterior surfaces of the side walls, the internal fore-to-aft dimension compatibly matching that of the single stack magazine tubular body, the external fore-to-aft dimension compatibly matching that of the single stack magazine tubular body, the external side-to-side dimension compatibly matching that of the single stack magazine tubular body, and the internal side-to-side dimension being greater than that of the single stack magazine tubular body, the metallic tubular body thereby providing an increase in ammunition capacity over and above that of the single stack magazine tubular body of the same external dimensions and length, a cut-out in the metallic tubular body adapted to receive a firearm magazine catch therein, the cut-out including an upper edge, and polymer over at least the upper edge of the cut-out.

In another aspect, the replacement magazine is a replacement for single stack polymer or polymer-over-metal magazines other than those manufactured by Glock®.

In another aspect, an increased capacity replacement firearm ammunition magazine for a polymer-over-metal single stack firearm ammunition magazine, for a Glock® handgun or another manufacturer's handgun, comprises a metallic tubular body having a forward wall, a rearward wall, a first side wall, and a second opposite side wall, the metallic tubular body walls having a wall thickness and the metallic tubular body having a length, the single stack magazine having a polymer-over-metal tubular body having a forward wall, a rearward wall, a first side wall, and a second opposite side wall, the single stack magazine tubular body walls having a wall thickness and the single stack magazine tubular body having a length, the wall thickness of the metallic tubular body walls being less than the wall thickness of the tubular body walls of the single stack magazine, the length of the metallic tubular body being substantially the same as the length of the single stack magazine tubular body, the forward wall of the metallic tubular body having at least one spacer projecting forwardly therefrom, the metallic tubular body having an internal fore-to-aft dimension spanning between interior surfaces of the forward and rearward walls, an external fore-to-aft dimension spanning between a forward edge of the at least one spacer and an exterior surface of the rearward wall, an internal side-to-side dimension spanning between interior surfaces of the side walls, and an external side-to-side dimension spanning between exterior surfaces of the side walls, the internal fore-to-aft dimension compatibly matching that of the single stack magazine tubular body, the external fore-to-aft dimension compatibly matching that of the single stack magazine tubular body, the external side-to-side dimension compatibly matching that of the single stack magazine tubular body, and the internal side-to-side dimension being greater than that of the single stack magazine tubular body, the metallic tubular body thereby providing an increase in ammunition capacity over and above that of the single stack magazine tubular body of the same external dimensions and length, and polymer over at least a portion of the metallic tubular body and forming an edge adapted to be engaged by a magazine catch.

The polymer can form the spacer at least in part.

The single stack magazine can have an ammunition capacity of ten 9×19 mm cartridges, and the replacement magazine can have an ammunition capacity of fifteen 9×19 mm cartridges.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION OF THE DRAWINGS

Figure 1:
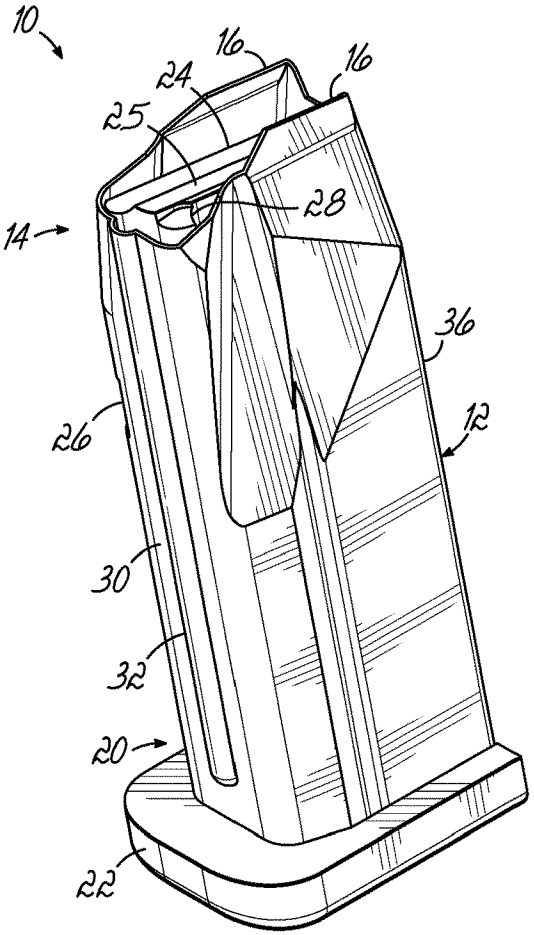
FIG. 1 is a right front perspective view of a fully loaded, increased capacity ammunition magazine according to an embodiment of the present invention, with the magazine body shown in phantom.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" indicates the direction of the muzzle and the direction in which projectiles are fired, while "rearward" indicates the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
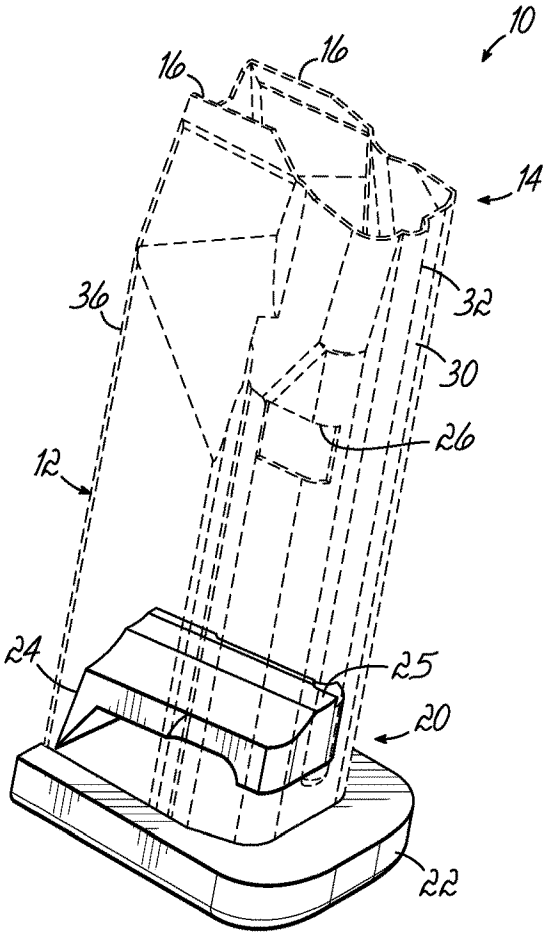
FIG. 2 is a view similar thereto with the ammunition cartridges removed.

Referring first to FIGS. 1-4, therein is shown a detachable box magazine 10 for a handgun according to one embodiment of the present invention. the Like other box magazines, it includes a generally tubular body 12 having an open upper end 14 (also known as the "mouth") with feed lips 16 that hold an ammunition cartridge 18 in place for feeding when the magazine 10 is inserted into a firearm. In FIGS. 1 and 2, the tube is shown in phantom so that the cartridges (FIG. 1) and follower 24 can be seen. A bottom end 20 of the body 12 is also open and accepts attachment of a base pad 22 or other removable closure member. According to one aspect of this embodiment, the magazine body 12 is formed of sheet metal material, such as steel, that will provide sufficient strength at a minimum of thickness. Typically, the body 12 is formed by stamping (or roll forming) with a longitudinal seam (not shown). The body 12 may include one or more cut-outs 26 that allow the magazine 10 to be retained by a magazine catch (not shown) in the magazine well of the firearm.

The illustrated embodiment is intended to replace a single stack or only slightly offset or slightly staggered type magazine having thicker walls made of polymer or polymer-over-metal, but with corresponding exterior dimensions so that it may be substituted and function otherwise identically in the same firearm. The illustrated magazine 10 is dimensioned for a Glock® 43X (or 48) handgun, which holds 9×19 mm cartridges (also known as 9 mm Parabellum or 9 mm Luger) and replaces a ten-round polymer-over-metal magazine with one that holds fifteen rounds in the same overall space. The present invention may be adapted to provide increased ammunition capacity replacing a single stack or slightly staggered row polymer or polymer-over-metal magazine for most any caliber or model. In other words, the replacement magazine of the present invention can be a replacement for a single stack polymer or polymer-over-metal magazine other than those manufactured by Glock®.

Figure 9:
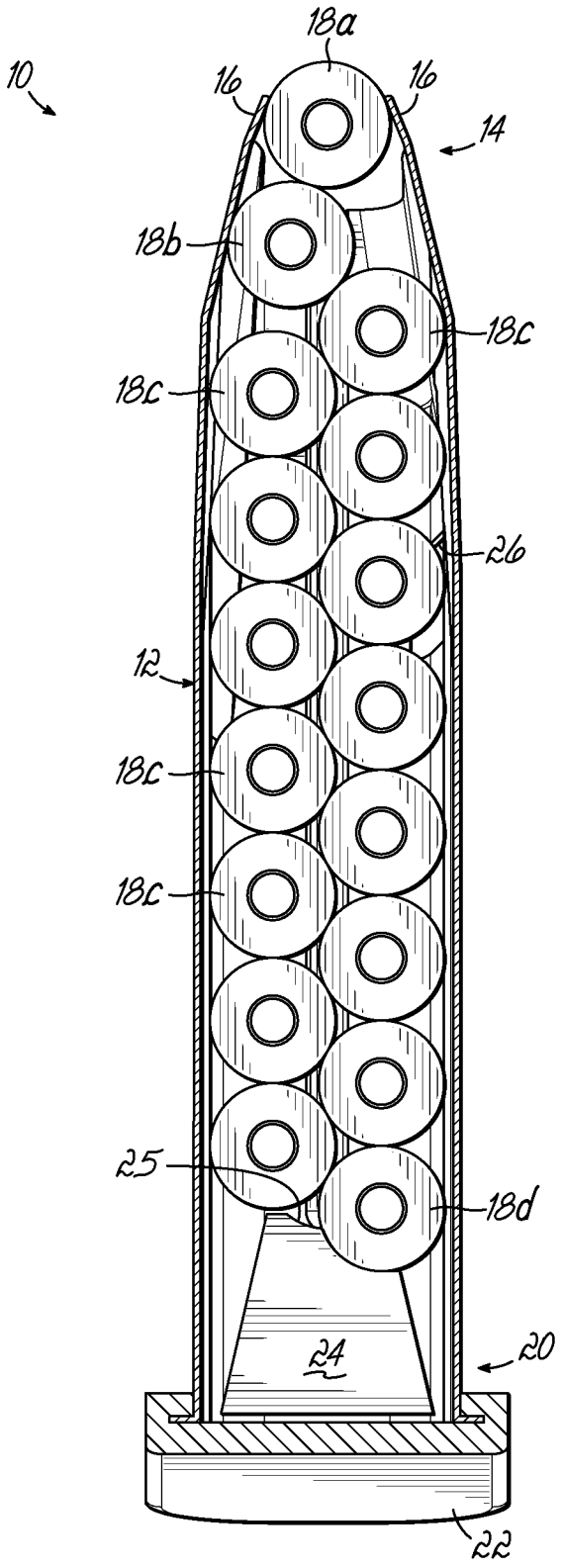
FIG. 9 a rear longitudinal cross-sectional view taken along line 9-9 of FIG. 4 with the magazine filled with cartridges.

Referring now also to FIG. 9, the body 14 holds a staggered or laterally offset row of cartridges 18, each situated substantially parallel to each other. At the bottom of the row of cartridges 18 is a follower 24 that is spring-biased toward the upper end 14 of the body 12. For clarity, the well-known compression spring is not shown, but would be compressed within the body 12 between the follower 24 and base pad 22 or other bottom closure member. As is well known, the spring-biased follower 24 will push the row(s) of cartridges 18 toward the upper end 14 and feed lips 16 as cartridges 18 are removed manually, or by cycling of the firearm's bolt/slide.

In a single stack magazine, the follower has a flat, generally laterally symmetric surface that bears against the cartridge. As shown in FIGS. 7-11, the follower 24 is laterally asymmetric so that the cartridge 18*d* against which it bears will be shifted to one side (in the illustrated embodiment, the right side) as additional cartridges 18 are loaded, causing subsequent cartridges 18 loaded into the magazine 10 to position themselves in this staggered or offset alignment. The follower 24 may be hollow and open to the bottom to reduce weight and material and/or to partially receive the internal magazine spring (not shown).

Figure 11:
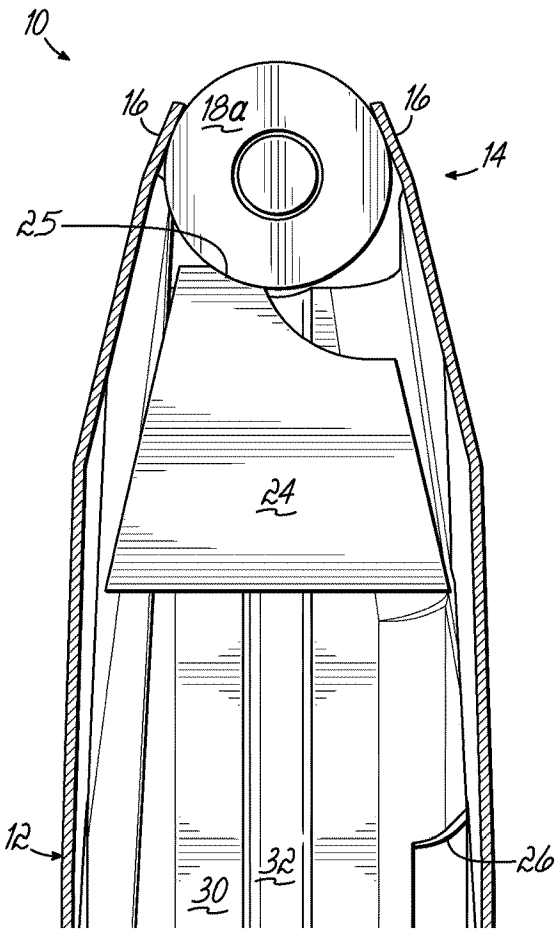
FIG. 11 is similar to FIG. 10 with one cartridge remaining.
Figure 10:
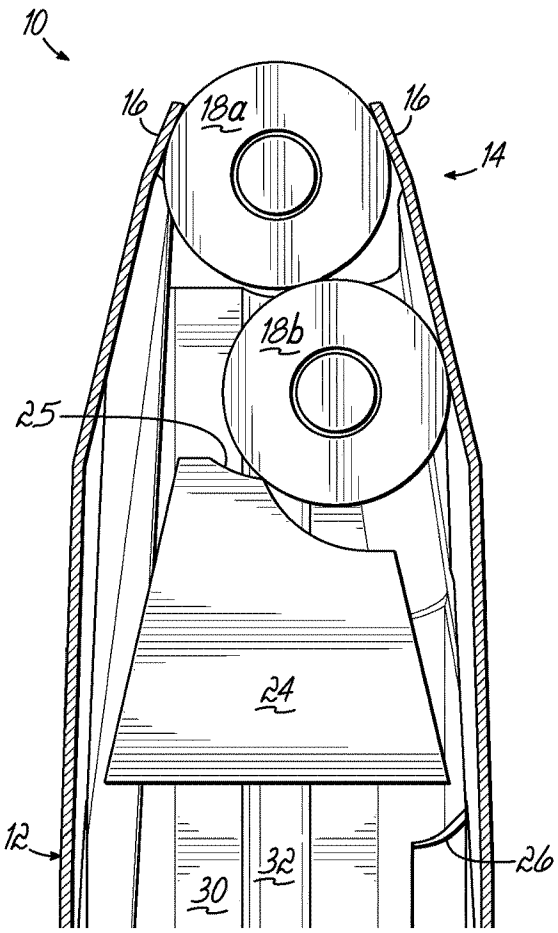
FIG. 10 is an enlarged rear cross-sectional view of the top portion of the magazine with two cartridges remaining.
Figure 15:
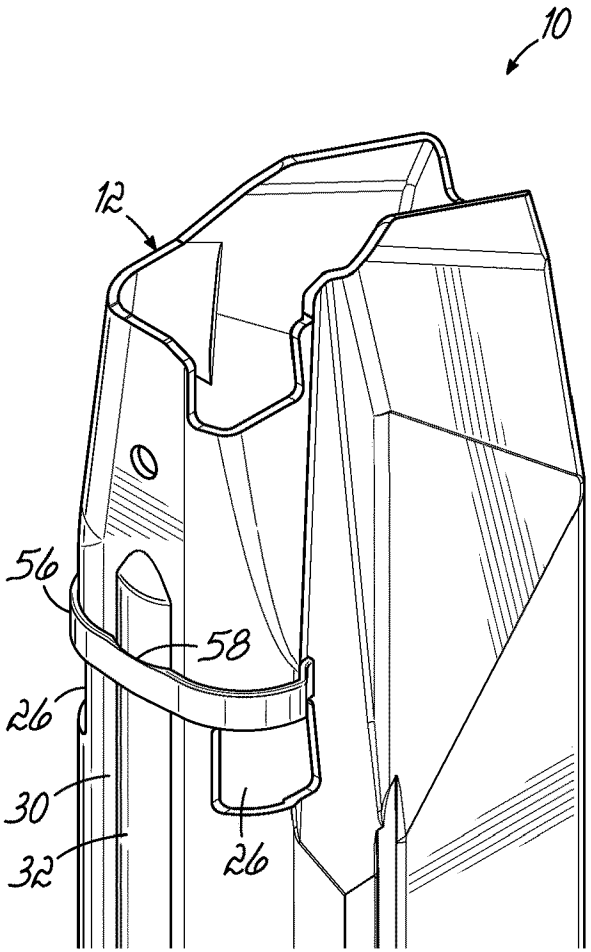
FIG. 15 is a left front perspective view thereof.
Figure 14:
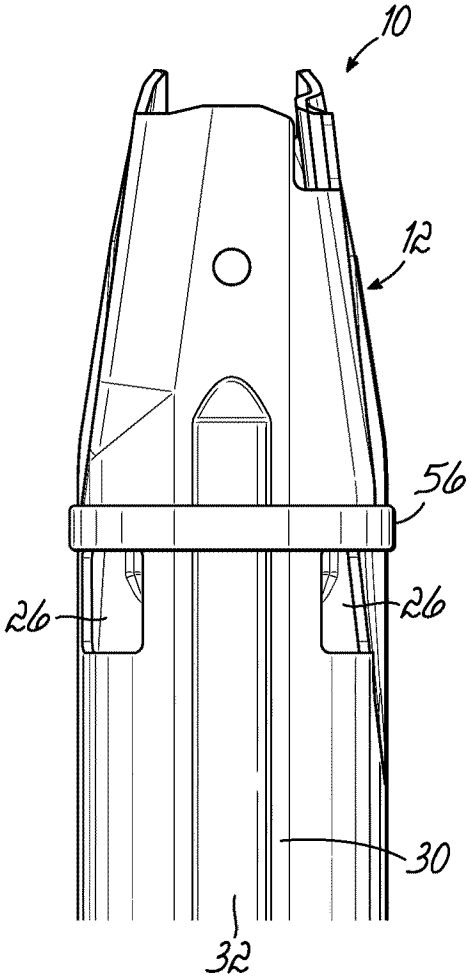
FIG. 14 is a front view thereof.
Figure 13:
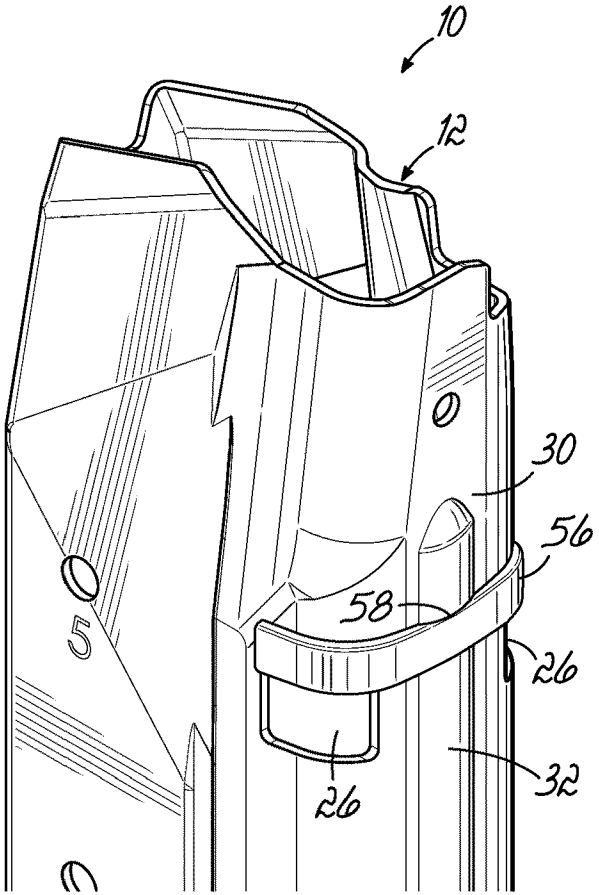
FIG. 13 is a right front perspective view of an alternative embodiment of an increased capacity ammunition magazine according to the present invention.
Figure 18:
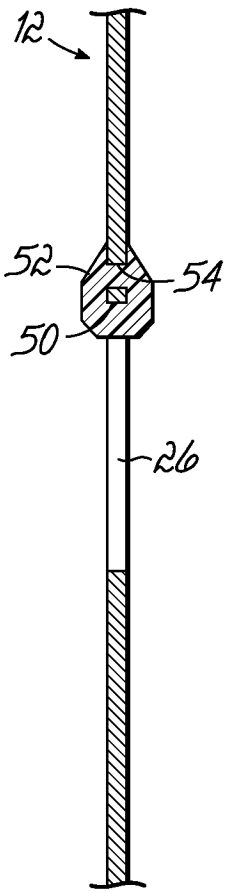
FIG. 18 is a cross-sectional view taken along line 18-18 in FIG. 17.
Figure 17:
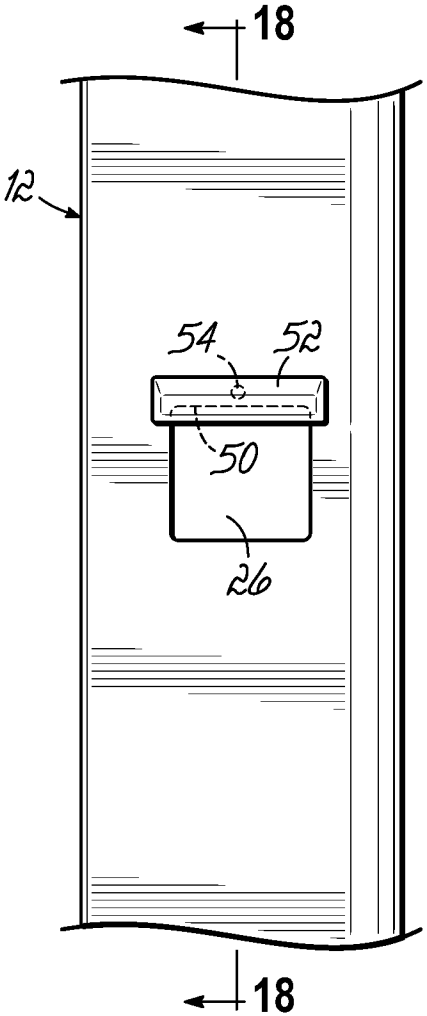
FIG. 17 is a view similar to FIG. 16 but after overmolding/throughmolding the upper edge of the cut-out with polymer material.
Figure 16:
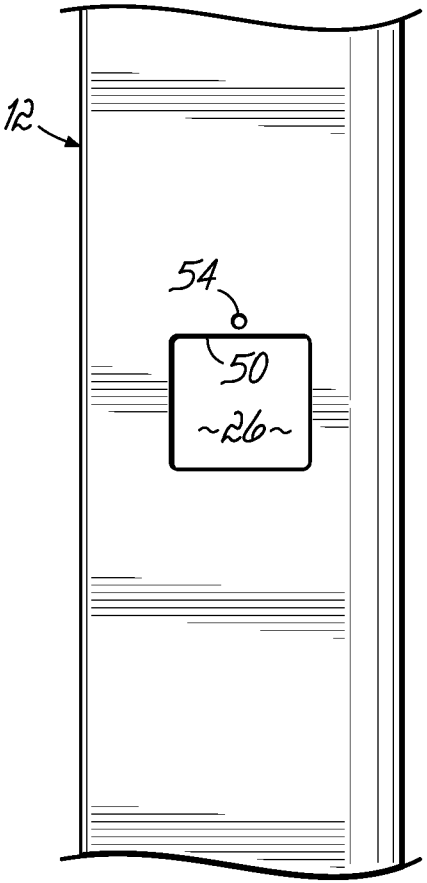
FIG. 16 is a view of the magazine cut-out, normal to the surface of the portion of the magazine body containing the cut-out, prior to overmolding/throughmolding the upper edge of the cut-out with polymer material.
Figure 20:
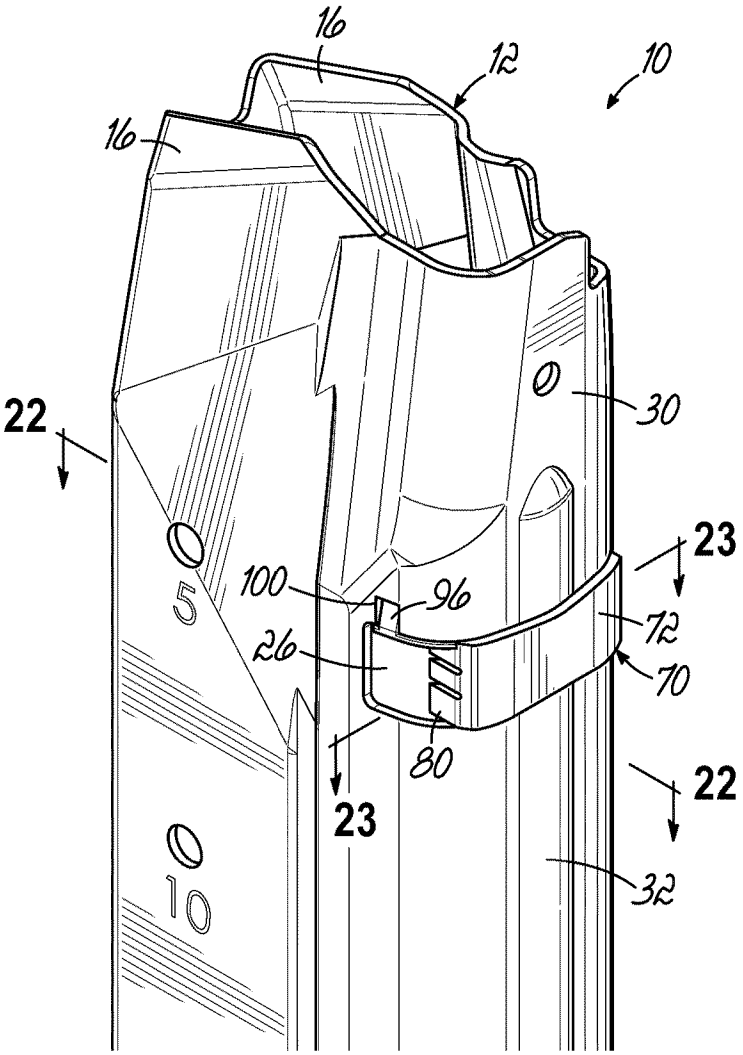
FIG. 20 is a right front assembled perspective view thereof.
Figure 19:
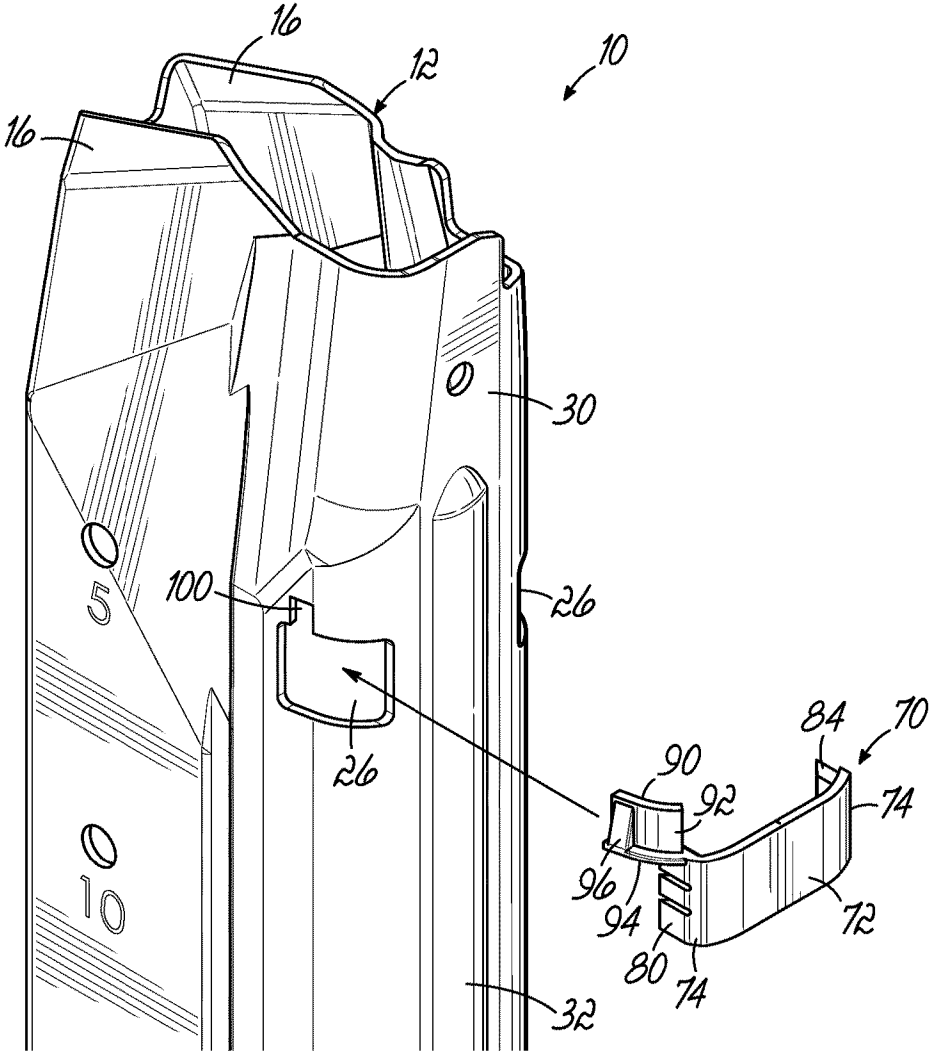
FIG. 19 is a right front disassembled perspective view of an alternative embodiment of the present invention.
Figure 22:
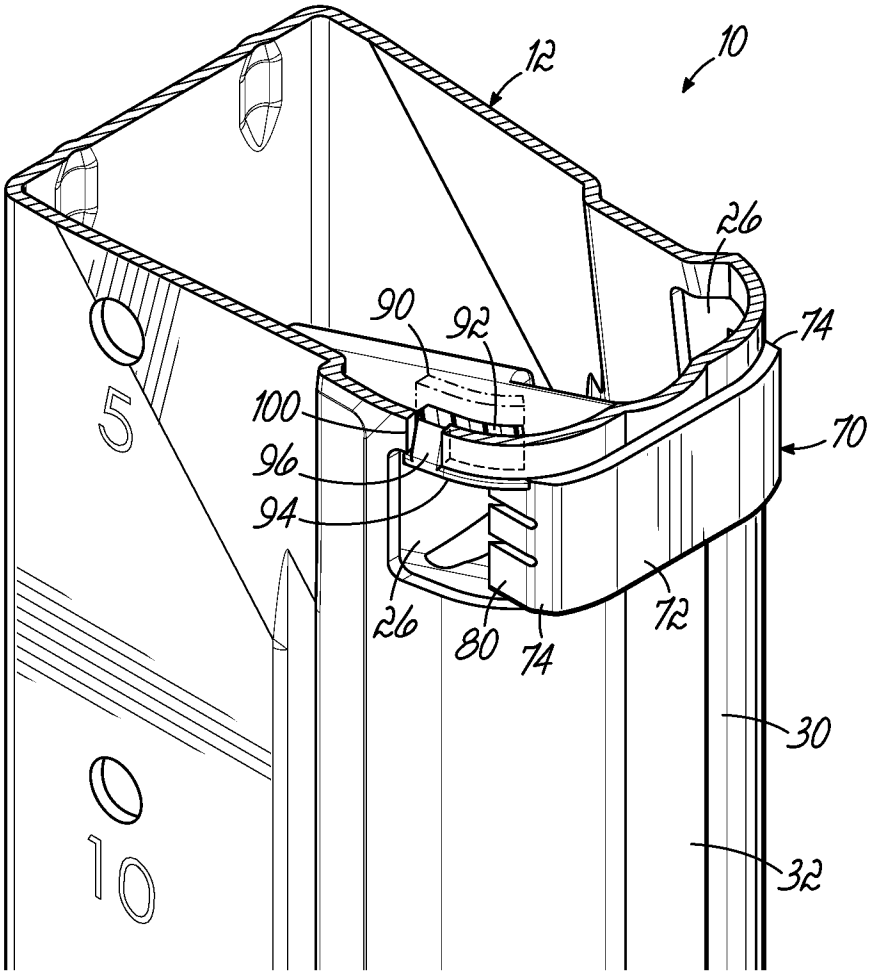
FIG. 22 is a cross-sectional view taken along line 22-22 in FIG. 20.
Figure 21:
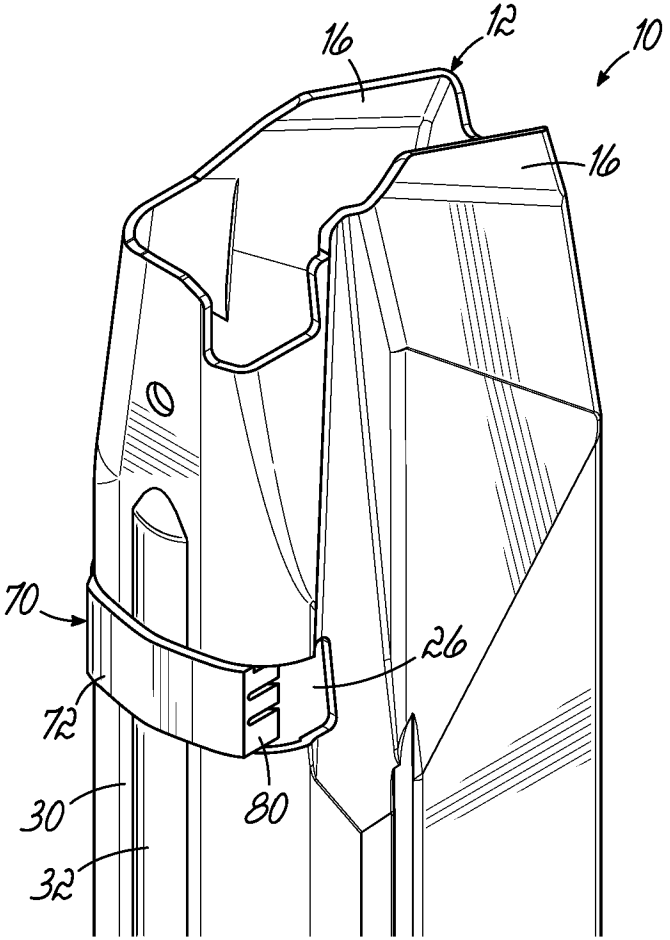
FIG. 21 is a left front assembled perspective view thereof.
Figure 23:
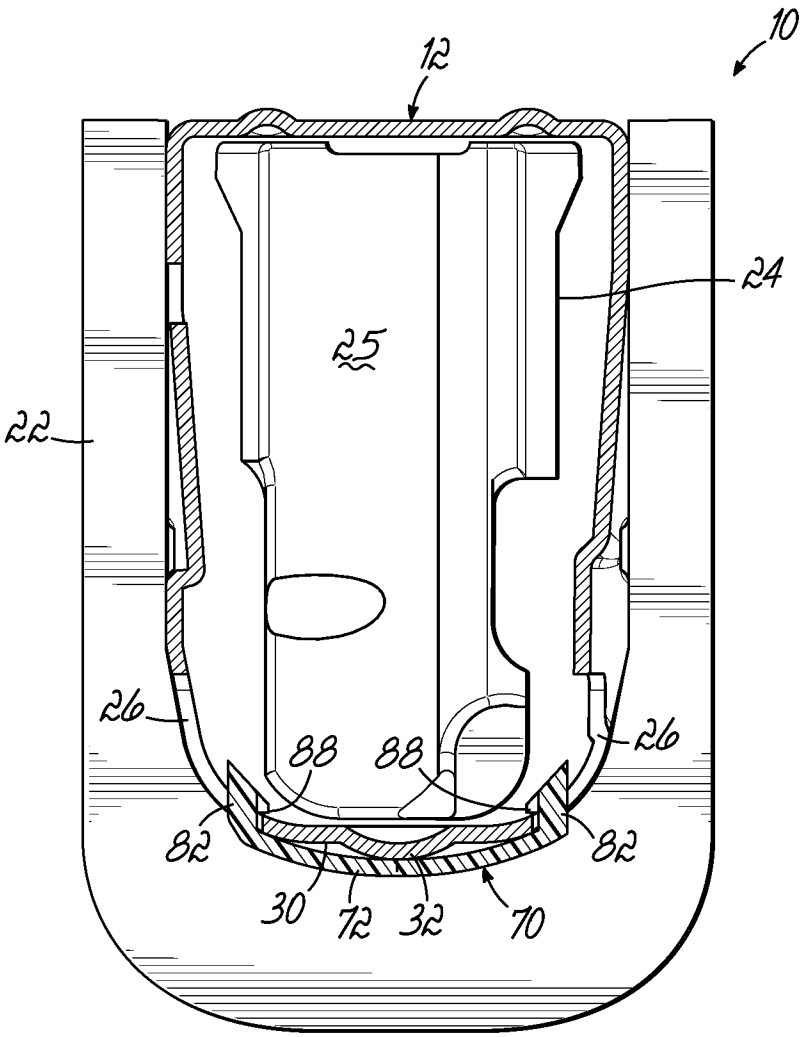
FIG. 23 is a cross-sectional view taken along line 23-23 in FIG. 20.
Figure 25:
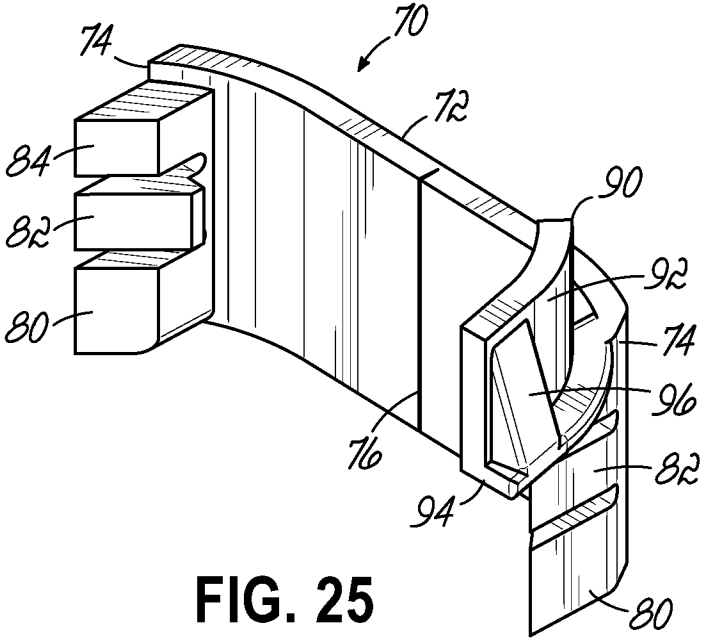
FIG. 25 is a right rear perspective view of the polymer clip.
Figure 24:
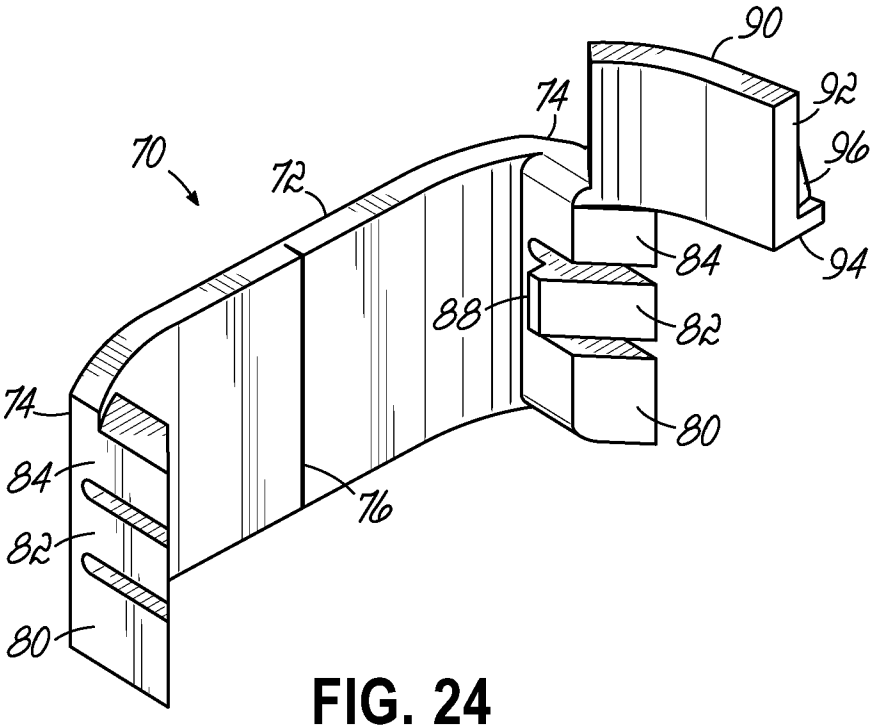
FIG. 24 is a left rear perspective view of the polymer clip.
Figure 26:
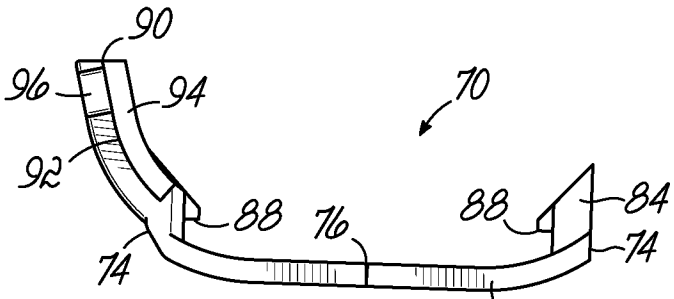
FIG. 26 is a top view of the polymer clip.

As shown in FIGS. 9-11, the cartridge 18*a* positioned against the feed lips 16 is substantially centered, the second-in-line cartridge 18*b* rides against an angled wall of the body 12 toward the center, while all of the remaining cartridges 18*c* are in an alternating staggered or at least partially offset positions. Unlike other magazine designs having a neck portion in which at least a second-in-line cartridge is also centered directly below the top cartridge, the present invention maximizes capacity by centering only the top cartridge and partially centering the second-in-line cartridge 18*b*. Magazines with a narrowed neck may also require an elongated follower, which sacrifices capacity. As shown in FIG. 11, when only one cartridge 18*a* remains in the magazine 10, the laterally converging walls at the upper end 14 of the body 12 center the cartridge 18 between the feed lips 16 and the raised platform area 25 of the follower 24 holds it in place.

Figure 12:
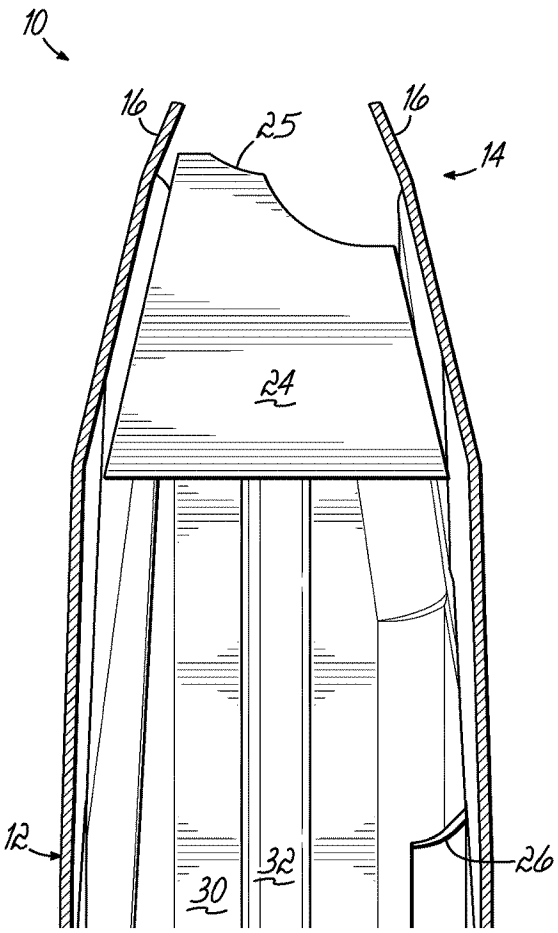
FIG. 12 is similar to FIG. 11 with no cartridges remaining.

Referring now also to FIG. 12, when the magazine 10 is empty, the follower 24 seats in the converging upper end 14 of the body 12. A notch 28 at the forward edge of the follower 24 may be provided to engage a slide or bolt catch, causing the action to remain open after the last round is discharged in a well-known manner.

The magazine 10 of the present invention provides increased capacity with a width dimension identical to that of the prior art single stack (or slightly staggered) magazine by utilizing thinner metallic walls that correspond to the exterior dimension of the lower-capacity magazine it replaces and staggering or offsetting all of the cartridges 18 below the upper most round without utilizing a narrowed neck region. The reduction in wall thickness provides the increased interior width needed to accommodate the increased capacity of cartridges, but it creates a problem of too much space in the forward/aft direction. If the cartridges are allowed to shift forward in the magazine tube/body, they will not be positioned to correctly or reliably feed from the lips. If the forward wall is set in to correctly guide the position of the cartridges, then the magazine will fit too loosely in the magazine well of the firearm.

Figure 3:
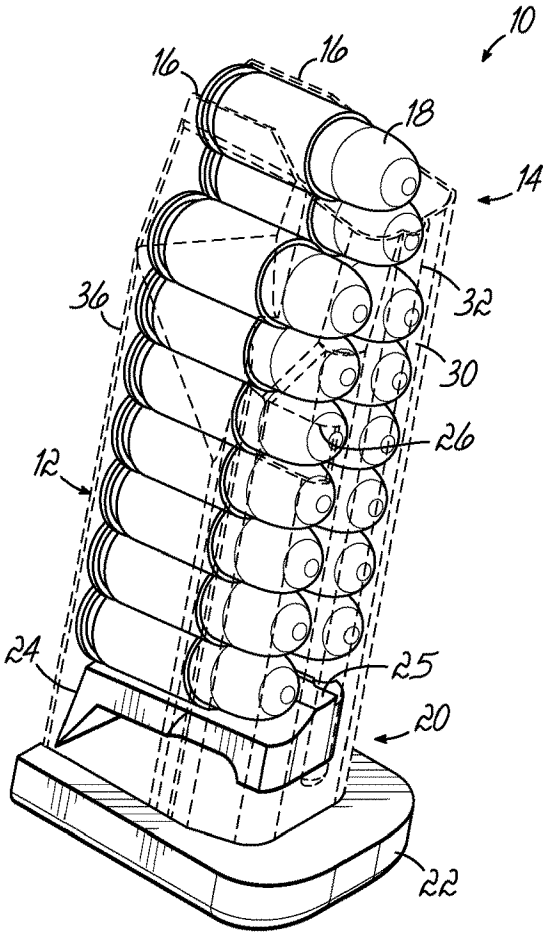
FIG. 3 is a left front perspective view of an increased capacity ammunition magazine according to an embodiment of the present invention empty and with the follower raised.
Figure 6:
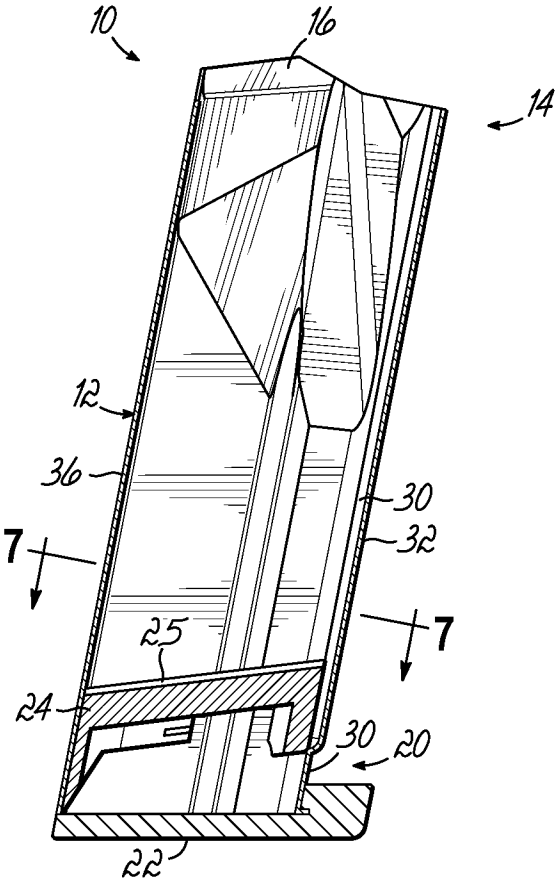
FIG. 6 is a view similar to FIG. 5 with the follower lowered.
Figure 5:
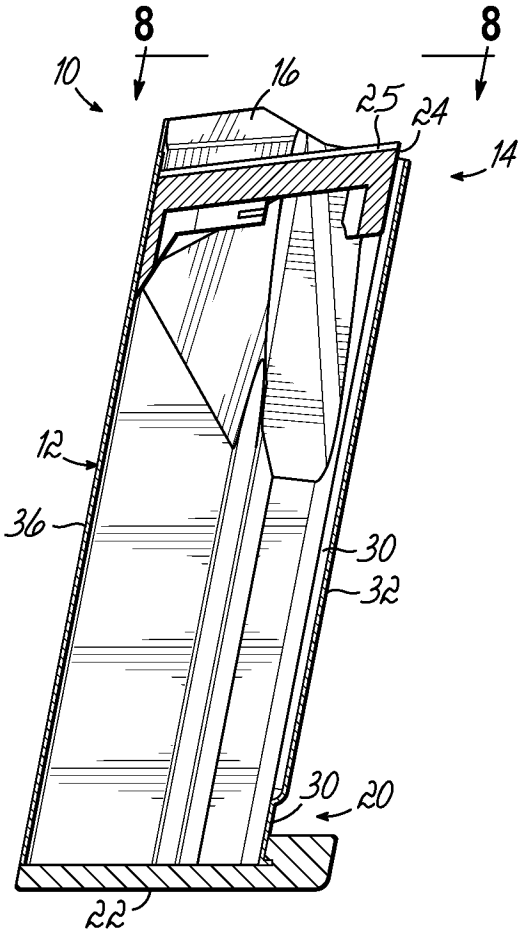
FIG. 5 is a right side cross-sectional view with the follower raised.
Figure 4:
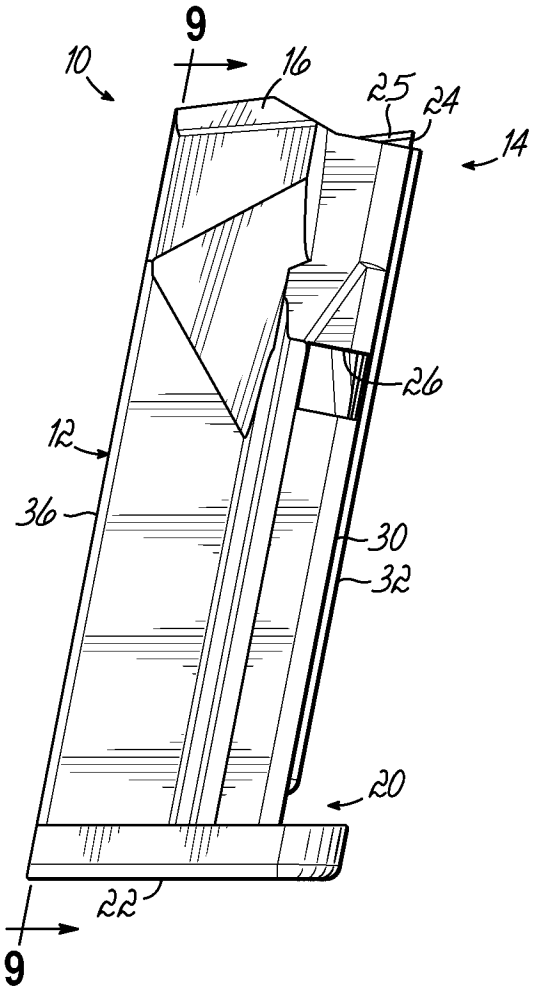
FIG. 4 is a right side view thereof.
Figure 8:
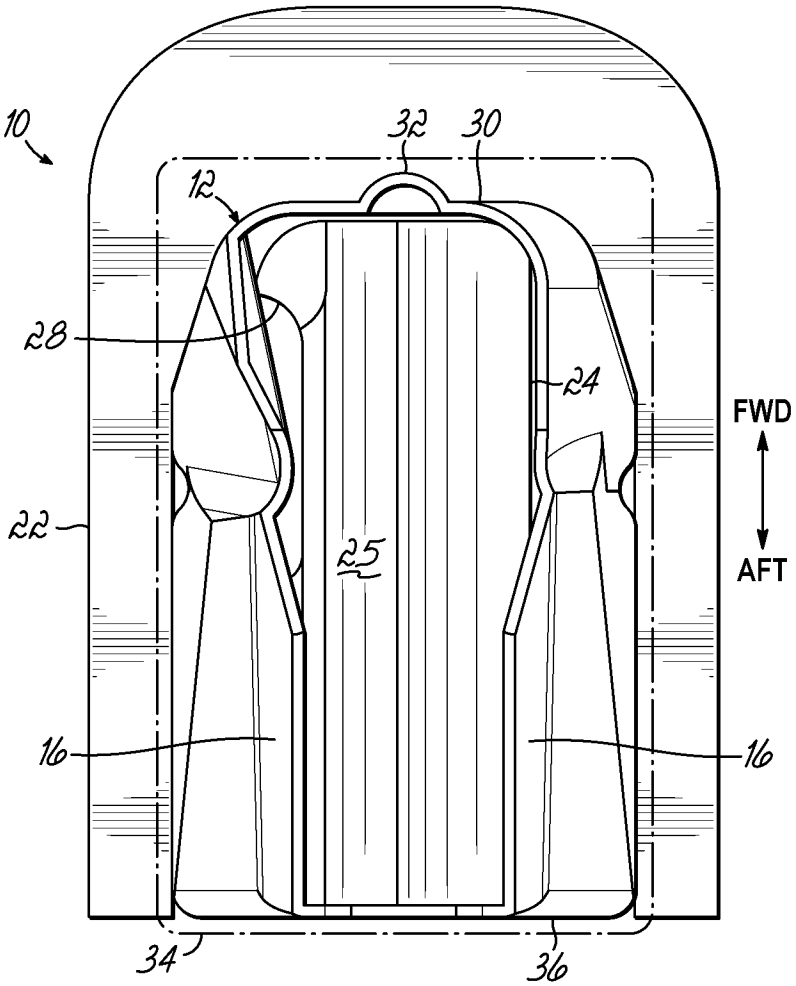
FIG. 8 is a top view taken along line 8-8 of FIG. 5.
Figure 7:
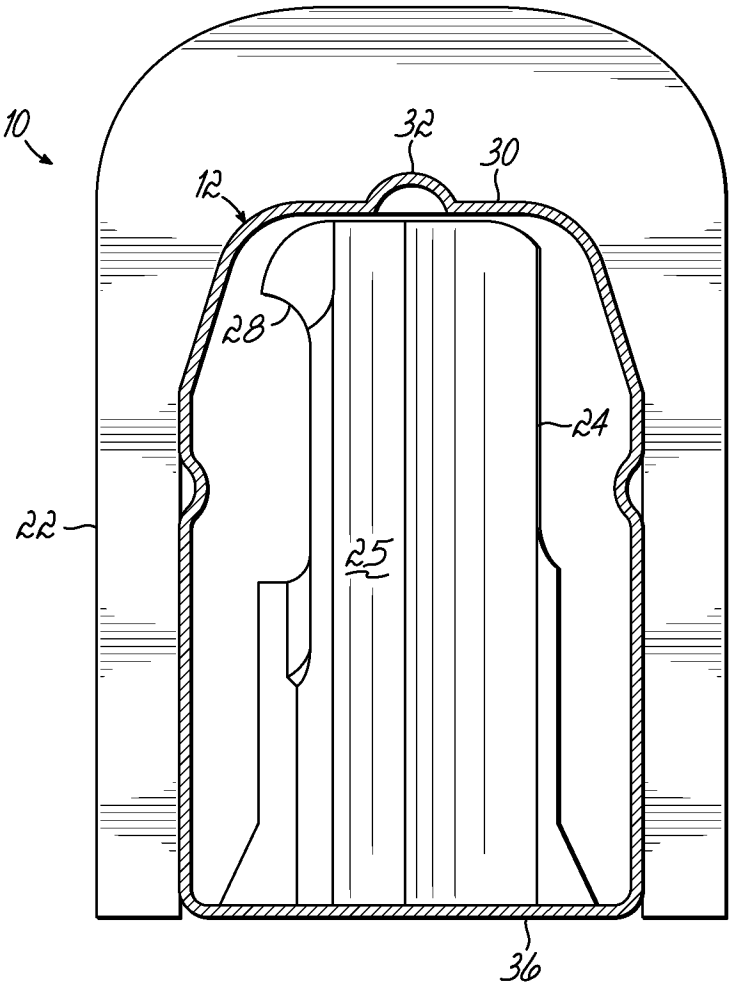
FIG. 7 a cross-sectional view taken along line 7-7 of FIG. 6.

As best seen in FIGS. 3, 7, and 8, according to one embodiment of the invention, a forwardly projecting spacer can take the form of a longitudinal rib or ridge 32 formed in the forward wall 30 of the metallic body 12. The ridge 32 can be stamped or roll formed into the metal as it is formed into the shape of the body 12. The forward wall 30 is positioned (in the fore/aft direction) to correctly guide the cartridges 18 and follower 24 and the ridge 32 guides the magazine body 12 to be correctly spaced in the magazine well (indicated with dash-dot line 34 in FIG. 8). This laterally centered position of the ridge 32 does not interfere with the feeding of the cartridges 18 or movement of the follower 24. The length of the ridge depends on what is necessary to adequately support the seated magazine 10. In the illustrated embodiment, the ridge 32 extends all the way to the top end 14 of the body 12, but it stops slightly short of the bottom end 20, where it could interfere with attachment of the base pad 22. If desired, or needed to properly feed, the compensated-for space can be divided between a forward rib or ridge 32 and a rearward rib or ridge (not shown) in the rear wall 36 of the body 12. Also if desired, the bottom end 20 of the body 12 could be shaped to mimic that of the OEM polymer or polymer over metal magazine so that an OEM base plate or extension (not shown) could be used. Of course, spacers other than the integrally formed rib(s) or ridge(s) 32 can be utilized, to include one or more polymer spacers, to be described below.

Referring now to FIGS. 13-18, to mitigate the wear of the steel magazine of the present invention on the Glock® OEM polymer magazine catch, polymer material can be placed over at least the upper edge 50 of the magazine catch cut-out 26 so as to cover the upper edge 50 with the polymer material. For example, the upper edge 50 can be overmolded and/or throughmolded with polymer material 52. At least one through hole 54 can be provided above the upper edge 50 of the cut-out. When the polymer 52 is overmolded to the upper edge 50, the polymer 52 flows through the through hole 54 to secure the polymer to inner and out surfaces of the body 12 and to the upper edge 50 of the cut-out 26, securing the polymer material 56 in place.

If desired, left and right cut-outs 26 with polymer overmolding/throughmolding at least the upper edge 50 of each cut-out 26 can be provided. In this way the magazine 10 can function with a firearm having a magazine catch that is reversible for left-handed or right-handed actuation. For example, the polymer 56 can extend from the left cut-out 26, around the forward wall 30 of the body 12, to the right cut-out 26. To accommodate the polymer 56 as it extends around the forward wall 30, a recess or relief 58 can be provided in the longitudinal rib or ridge 32 such that the outermost surface of the polymer 56 is essentially flush with the outermost surface of the rib 32. Alternatively, the longitudinal rib or ridge could be formed of polymer material integral with the polymer material that provides the covering for the at least upper edge of the cut-outs 26, thus providing an alternative spacer.

Due to the locations of the cut-outs 26 in the body 12 (essentially at the forward corners), the polymer 52 or 56 can be secured to an inner surface of body 12 and "wrapped around" the upper edge 50 of cut-out 26 with no deleterious effect on the increased capacity of the magazine of the present invention. This for the reason that the location at which the polymer 52 or 56 extends inward from the inner surface of body 12 is at a point where it does not interfere with, or otherwise contact, the cartridges.

Referring now to FIGS. 19-26, another technique for placing polymer material over at least the upper edge 50 of the magazine catch cut-out 26 so as to cover the upper edge 50 with the polymer material is illustrated. For example, a polymer clip 70 can be utilized to cover the upper edge 50 and/or form the spacer.

More particularly, polymer clip 70 includes a front portion 72 and left and right side portions 74. Front portion 72 can include a generally vertical living hinge 76 to assist the front portion 72 and side portions 74 in wrapping from the left cut-out 26, around the forward wall 30 of the body 12, to the right cut-out 26. To accommodate the polymer 56 as it extends around the forward wall 30, a recess or relief 58 can be provided in the longitudinal rib or ridge 32 such that the outermost surface of the polymer 56 is essentially flush with the outermost surface of the rib 32. Alternatively, the longitudinal rib or ridge could be formed of polymer material integral with the polymer material that provides the covering for the at least upper edge of the cut-outs 26, thus providing an alternative spacer.

Each side portion includes three resilient and vertically spaced fingers 80, 82, 84 which fit into the forward portion of the cut-outs 26. Each middle finger 82 includes a lip or flange 88 that resiliently snaps around the forward vertical edge of its respective cut-out 26 to retain the clip 70 in place. At least the right portion 74 includes an L-shaped structure 90 projecting upwardly from the upper finger 84. In the case of a firearm having a magazine catch that is reversible for left-handed or right-handed actuation, the clip 70 would include the L-shaped structure 90 on the left and right portions 74 of the clip 70.

The L-shaped structure 90 includes a generally vertically leg portion 92 and a generally horizontal foot portion 94. A generally triangular gusset 96 interconnects the leg and foot portions 92, 94. Cut-out 26 includes an upwardly extending notch 100 to accommodate gusset 96. When installed, the foot portion 92 covers the upper edge 50 of cut-out 26 in the body 12, and the leg portion 94 overlies an inner surface of the body 12 above the upper edge 50 of the cut-out 26.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. The invention resides in each individual feature described herein, alone, and in any and all combinations and subcombinations of any and all of those features. Accordingly, all suitable modifications and equivalents may be included and considered to fall within the scope of the invention, defined by the following claim or claims.

What is claimed is:

1. A pistol magazine, comprising:

a metallic tubular body defining a hollow interior and having a forward wall, a rearward wall, a first side wall, a second opposite side wall, an open top with feed lips, and an open bottom, a removable closure member enclosing the open bottom of the body, the forward wall having at least one longitudinally extending spacer projecting forwardly therefrom, at least one of the first and second side walls having an edge configured to interact with a magazine catch of a polymer frame pistol configured to accommodate a single stack polymer or polymer-over-metal magazine, a first internal dimension between the forward wall and the rearward wall dimensioned to fit 9×19 mm cartridges, a second internal dimension between the first side wall and the second opposite side wall dimensioned to fit 9×19 mm cartridges with a staggered arrangement of the cartridges, the body having a height dimension configured to fit within a handgrip of the polymer frame pistol and locate the removable closure member directly adjacent to the bottom of the handgrip when the magazine is inserted into the handgrip of the polymer frame pistol, a first external dimension of the body from the forwardmost surface of the spacer to the rearmost surface of the rearward wall matching the corresponding exterior dimension of the single stack polymer or polymer-over-metal magazine, and a second external dimension of the body from the external surface of the first side wall to the external surface of the second side wall matching the corresponding exterior dimension of the single stack polymer or polymer-over-metal magazine, wherein the edge is formed of polymer.

2. The magazine of claim 1, wherein the magazine has an increased ammunition capacity of at least 50% over and above that of the single stack polymer or polymer-over-metal magazine.

3. The magazine of claim 1, wherein the magazine has an ammunition capacity of fifteen rounds and the single stack polymer or polymer-over-metal magazine has an ammunition capacity of ten rounds.

4. The magazine of claim 1, wherein an upper portion of the body is formed such that a first upper cartridge is centered side-to-side, a third cartridge down from the first cartridge is fully staggered side-to-side, and a second cartridge down from the first cartridge is only partially staggered side-to-side.

5. The magazine of claim 1, wherein the spacer is integrally formed as a part of the forward wall of the body.

6. The magazine of claim 5, wherein the spacer is a protrusion stamped into the forward wall.

7. The magazine of claim 6, wherein the protrusion is a rib.

8. The magazine of claim 1, wherein the spacer is formed at least in part of polymer.

9. The magazine of claim 1, wherein the at least one of the first and second side walls has a cut-out with an upper edge, the polymer covering the upper edge of the cut-out.

10. The magazine of claim 9, wherein the polymer is overmolded over the upper edge of the cut-out.

11. The magazine of claim 10, wherein the at least one of the first and second side walls includes at least one through hole above the upper edge of the cut-out, whereby when the polymer is overmolded the polymer flows through the through hole to secure the polymer to inner and outer surfaces of the at least one of the first and second side walls and to the upper edge of the cut-out.

12. The magazine of claim 1, wherein each of the first and second side walls has a cut-out with an upper edge, the polymer covering the upper edges of the cut-outs.

13. The magazine of claim 12, wherein each of the first and second side walls includes at least one through hole above the upper edge of the cut-out, whereby when the polymer is overmolded the polymer flows through the through holes to secure the polymer to inner and outer surfaces of the first and second side walls and to the upper edges of the cut-outs.

14. The magazine of claim 13, wherein the polymer extends from the cut-out in the first side wall, around the forward wall, and to the cut-out in the second side wall.

15. The magazine of claim 14, wherein the spacer includes a recess therein to accommodate the polymer extending around the forward wall.

16. The magazine of claim 9, wherein the polymer is formed as a resilient clip which snaps into the cut-out and over the upper edge of the cut-out.

17. The magazine of claim 16, wherein each of the first and second side walls has a cut-out, and wherein the polymer clip extends from the cut-out in the first side wall, around the forward wall, and to the cut-out in the second side wall, and snaps into each cut-out and over the upper edge of each cut-out.

18. The magazine of claim 17, wherein the spacer includes a recess therein to accommodate the polymer clip extending around the forward wall.

19. The magazine of claim 17, wherein the clip comprises:

a front portion and left and right side portions, the front portion including a generally vertical living hinge therein, each left and right side portion including three resilient and vertically spaced fingers which fit into respective ones of the cut-outs in the first and second side walls, middle ones of the fingers each including a lip that resiliently snaps around a forward vertical edge of its respective cut out, at least one of the left and right portions including an L-shaped structure projecting upwardly from an upper one of the fingers, the L-shaped structure including a generally vertical leg portion and a generally horizontal foot portion and a generally triangular gusset interconnecting the leg and foot portions, and at least one of the cut-outs including an upwardly extending notch to accommodate the gusset, whereby the foot portion covers the upper edge of the at least one cut-out and the leg portion overlies an inner surface of the side wall above the upper edge of the at least one cut-out.

20. A pistol magazine, comprising:

a metallic tubular body defining a hollow interior and having a forward wall, a rearward wall, a first side wall, a second opposite side wall, an open top with feed lips, and an open bottom, a removable closure member enclosing the open bottom of the body, both of the first and second side walls having an edge formed of polymer configured to interact with a magazine catch of a polymer frame pistol configured to accommodate a single stack polymer or polymer-over-metal magazine, the polymer extending from the edge of the first side wall around the forward wall to the edge of the second side wall and defining at least a part of a spacer projecting forwardly from the forward wall, a first internal dimension between the forward wall and the rearward wall dimensioned to fit 9×19 mm cartridges, a second internal dimension between the first side wall and the second opposite side wall dimensioned to fit 9×19 mm cartridges with a staggered arrangement of the cartridges, the body having a height dimension configured to fit within a handgrip of the polymer frame pistol and locate the removable closure member directly adjacent to the bottom of the handgrip when the magazine is inserted into the handgrip of the polymer frame pistol, a first external dimension of the body from the forwardmost surface of the spacer to the rearmost surface of the rearward wall matching the corresponding exterior dimension of the single stack polymer or polymer-over-metal magazine, and a second external dimension of the body from the external surface of the first side wall to the external surface of the second side wall matching the corresponding exterior dimension of the single stack polymer or polymer-over-metal magazine.

21. The magazine of claim 20, wherein the magazine has an increased ammunition capacity of at least 50% over and above that of the single stack polymer or polymer-over-metal magazine.

22. The magazine of claim 20, wherein the magazine has an ammunition capacity of fifteen rounds and the single stack polymer or polymer-over-metal magazine has an ammunition capacity of ten rounds.

23. The magazine of claim 20, wherein an upper portion of the body is formed such that a first upper cartridge is centered side-to-side, a third cartridge down from the first cartridge is fully staggered side-to-side, and a second cartridge down from the first cartridge is only partially staggered side-to-side.

24. The magazine of claim 20, wherein the spacer is further defined at least in part by a protrusion stamped into the forward wall.

25. The magazine of claim 24, wherein the protrusion is a rib.

26. A pistol magazine, comprising:

a metallic tubular body defining a hollow interior and having a forward wall, a rearward wall, a first side wall, a second opposite side wall, an open top with feed lips, and an open bottom, a removable closure member enclosing the open bottom of the body, at least one longitudinally extending spacer on the forward wall projecting forwardly therefrom, an edge on at least one of the first and second side walls configured to interact with a magazine catch of a polymer frame pistol configured to accommodate a single stack polymer or polymer-over-metal magazine, a first interior dimension between the forward wall and the rearward wall dimensioned to fit 9×19 mm cartridges, a second interior dimension between the first side wall and the second side wall dimensioned to fit 9×19 mm cartridges with a staggered arrangement of the cartridges, a first exterior dimension between the forwardmost surface of the spacer and the rearward wall matching the corresponding exterior dimension of the single stack polymer or polymer-over-metal magazine, a second exterior dimension between the first side wall and the second side wall matching the corresponding exterior dimension of the single stack polymer or polymer-over-metal magazine, and the body having a height dimension configured to fit within a handgrip of the polymer frame pistol and locate the removable closure member directly adjacent to the bottom of the handgrip when the magazine is inserted into the handgrip of the polymer frame pistol, wherein the edge is formed of polymer.

27. The magazine of claim 26, wherein the magazine has an increased ammunition capacity of at least 50% over and above that of the single stack polymer or polymer-over-metal magazine.

28. The magazine of claim 26, wherein the magazine has an ammunition capacity of fifteen rounds and the single stack polymer or polymer-over-metal magazine has an ammunition capacity of ten rounds.

29. The magazine of claim 26, wherein an upper portion of the body is formed such that a first upper cartridge is centered side-to-side, a third cartridge down from the first cartridge is fully staggered side-to-side, and a second cartridge down from the first cartridge is only partially staggered side-to-side.

30. The magazine of claim 26, wherein the spacer is integrally formed as a part of the forward wall of the body.

31. The magazine of claim 30, wherein the spacer is a protrusion stamped into the forward wall.

32. The magazine of claim 31, wherein the protrusion is a rib.

33. The magazine of claim 26, wherein the spacer is formed at least in part of polymer.

34. The magazine of claim 26, wherein the at least one of the first and second side walls includes at least one through hole, whereby when the polymer is overmolded over the at least one of the first and second side walls polymer flows through the through hole to secure the polymer to the at least one of the first and second side walls.

35. The magazine of claim 26, wherein both of the first and second side walls have a polymer edge, and wherein the polymer extends from the first side wall, around the forward wall, and to the second side wall.

36. A pistol magazine, comprising:

a metallic tubular body defining a hollow interior and having a forward wall, a rearward wall, a first side wall, a second opposite side wall, an open top with feed lips, and an open bottom, a removable closure member enclosing the open bottom of the body, at least one longitudinally extending spacer on the forward wall projecting forwardly therefrom, an edge on each of the first and second side walls configured to interact with a magazine catch of a polymer frame pistol configured to accommodate a single stack polymer or polymer-over-metal magazine, a first interior dimension between the forward wall and the rearward wall dimensioned to fit 9×19 mm cartridges, a second interior dimension between the first side wall and the second side wall dimensioned to fit 9×19 mm cartridges with a staggered arrangement of the cartridges, a first exterior dimension between the forwardmost surface of the spacer and the rearward wall matching the corresponding exterior dimension of the single stack polymer or polymer-over-metal magazine, a second exterior dimension between the first side wall and the second side wall matching the corresponding exterior dimension of the single stack polymer or polymer-over-metal magazine, and the body having a height dimension configured to fit within a handgrip of the polymer frame pistol and locate the removable closure member directly adjacent to the bottom of the handgrip when the magazine is inserted into the handgrip of the polymer frame pistol, wherein the spacer and the edges are formed of polymer overmolded to the first and second side walls and the forward wall.

37. The magazine of claim 36, wherein each of the first and second side walls includes at least one through hole, whereby when the polymer is overmolded over the first and second side walls polymer flows through the through holes to secure the polymer to the first and second side walls.

38. A pistol magazine, comprising:

a metallic tubular body defining a hollow interior and having a forward wall, a rearward wall, a first side wall, a second opposite side wall, an open top with feed lips, and an open bottom, a removable closure member enclosing the open bottom of the body, at least one longitudinally extending spacer on the forward wall projecting forwardly therefrom, polymer overmolded over the first side wall, the forward wall, and the second side wall and forming an edge on each of the first and second side walls configured to interact with a magazine catch of a polymer frame pistol configured to accommodate a single stack polymer or polymer-over-metal magazine, a first interior dimension between the forward wall and the rearward wall dimensioned to fit 9×19 mm cartridges, a second interior dimension between the first side wall and the second side wall dimensioned to fit 9×19 mm cartridges with a staggered arrangement of the cartridges, a first exterior dimension between the forwardmost surface of the spacer and the rearward wall matching the corresponding exterior dimension of the single stack polymer or polymer-over-metal magazine, a second exterior dimension between the first side wall and the second side wall matching the corresponding exterior dimension of the single stack polymer or polymer-over-metal magazine, and the body having a height dimension configured to fit within a handgrip of the polymer frame pistol and locate the removable closure member directly adjacent to the bottom of the handgrip when the magazine is inserted into the handgrip of the polymer frame pistol.

39. The magazine of claim 38, wherein each of the first and second side walls includes at least one through hole, whereby when the polymer is overmolded over the first and second side walls polymer flows through the through holes to secure the polymer to the first and second side walls.

40. The magazine of claim 38, wherein the spacer is integrally formed as a part of the forward wall.

41. The magazine of claim 38, wherein the spacer is not integrally formed as a part of the forward wall.

* * * * *